US005385260A

United States Patent [19]

Gatcomb

[11] Patent Number: 5,385,260

[45] Date of Patent: Jan. 31, 1995

[54] DISPOSABLE CUP ASSEMBLY SYSTEM AND METHOD

[75] Inventor: James Gatcomb, Simsbury, Conn.

[73] Assignee: Sherwood Industries, Inc., Kensington, Conn.

[21] Appl. No.: 183,670

[22] Filed: Jan. 19, 1994

[51] Int. Cl.[6] ..... B65D 3/22

[52] U.S. Cl. ..... 220/415; 229/400; 439/100; 439/114; 439/115; 439/908

[58] Field of Search ..... 229/1.5 B, 4.5; 220/410, 415, 441, 443; 206/516, 519; 493/84, 89, 100, 114, 115, 908

[56] References Cited

U.S. PATENT DOCUMENTS

| | | | |
|---|---|---|---|
| 1,679,621 | 8/1928 | Myers | 220/410 |
| 2,563,352 | 8/1951 | Morse | 220/415 |
| 3,203,611 | 8/1965 | Anderson et al. | 229/1.5 B |
| 3,456,860 | 7/1969 | Janninck | 229/1.5 B |
| 3,797,369 | 3/1974 | Amberg | 493/100 |
| 3,908,523 | 9/1975 | Shikaya | 229/1.5 B |
| 5,076,463 | 12/1991 | McGraw | 220/415 |
| 5,092,485 | 3/1992 | Lee | 229/1.5 B |
| 5,145,107 | 9/1992 | Silver et al. | 229/1.5 B |
| 5,205,473 | 4/1993 | Coffin, Sr. | 229/1.5 B |
| 5,226,585 | 7/1993 | Varano | 229/1.5 B |

*Primary Examiner*—Gary E. Elkins

*Attorney, Agent, or Firm*—McCormick, Paulding & Huber

[57] ABSTRACT

A disposable paper cup for serving cold food products and beverages is converted into a hot cup by the addition of an insulating sleeve assembled on the cold cup by the user. One part of a cohesive compound carried by the cold cup cooperates in registry with another part of the cohesive compound carried by the insulating sleeve to instantaneously and aggressively adhere the sleeve in assembly with the cold cup when the sleeve is mounted on the cold cup by the user.

20 Claims, 2 Drawing Sheets

DISPOSABLE CUP ASSEMBLY SYSTEM AND METHOD

BACKGROUND OF THE INVENTION

This invention relates in general to disposable containers and deals more particularly with an improved means for providing disposable insulated containers or hot cups for use in serving hot foods and beverages.

A cup particularly designed for containing a cold beverage is generally not well suited for serving a hot beverage such as coffee. This is particularly true of cups of larger size, since there is a tendency to more firmly grasp a large cup, which increases the rate of heat transfer from the cup to the hand and may result in considerable discomfort. Heretofore, various dual purpose disposable containers and cups have been provided which are suitable for serving either hot or cold foods or beverages. However, such containers and cups generally include some form of insulation and are usually more expensive than those required for cold food or beverage service. Further, such dual purpose cups are often made from environmentally unfriendly plastic materials which are not readily biodegradably or recyclable and which present difficult disposal problems.

Consequently, many restaurants and fast food establishments prefer to stock two types of containers, one for cold food and beverage service and another for serving hot foods and beverages. Such practice generally results in improved customer satisfaction. However, a relatively large inventory of disposable containers is required which results in increased cost. A further problem may be encountered by the small food establishment having limited storage space for maintaining cup inventory. The present invention is concerned with these problems.

It is the general aim of the present invention to provide an improved disposable cup assembly system which reduces the cost of providing insulated hot cups and enables reduction in the users required cup inventory.

SUMMARY OF THE INVENTION

In accordance with the invention, a disposable cup assembly comprises a basic cold cup made from sheet material and having a frustoconical sidewall, a radially disposed bottom wall and a radially disposed annular rim at the upper end of the sidewall which defines a circular opening at the upper end of the cup. A frustoconical insulating sleeve made from sheet material comprises a means for converting the cold cup into a hot cup for containing hot liquid and receives the cold cup in an assembled condition therein. Spacing means associated with the sleeve may be provided for engaging the sidewall in assembled condition to retain portions of the sleeve in outwardly spaced insulating relation to associated portions of the sidewall. The assembly further includes a cohesive material which has a first part disposed on a portion of the outer surface of the sidewall and a second part disposed on a portion of the inner surface of the sleeve for registry with the first part when the sleeve and cold cup are in assembled condition. The first and second cohesive parts instantaneously cooperate in adhering engagement with each other when the cold cup and the insulating sleeve are moved in assembled condition and secure the insulating sleeve and the cold cup in the assembled condition.

DETAILED DESCRIPTION OF PREFERRED EMBODIMENTS AND METHODS

Figure 1:
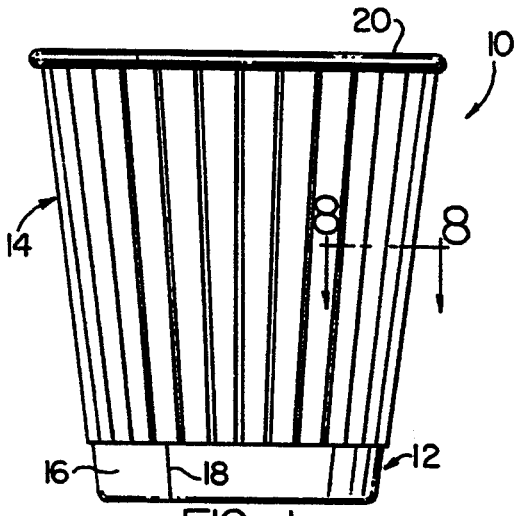
FIG. 1 is a side elevational view of a disposable insulated cup assembly embodying the present invention and shown in assembled condition.

Turning now to the drawings an insulated hot cup embodying the present invention and assembled in accordance with the invention is shown in FIG. 1 and indicated generally by the reference numeral 10. The illustrated hot cup assembly 10 is particularly adapted for containing and serving a hot beverage or food product and essentially comprises a basic cold cup, shown in FIGS. 2–4 and indicated generally by the reference numeral 12, and an insulating sleeve, illustrated in FIG. 5 and designated generally by the numeral 14. The cold cup 12 and the insulating sleeve 14 are secured in assembly by a two part cohesive material hereinafter designated generally by the letter C which includes a first part indicated by the letter A and carried by the cold cup 12 and a second part designated by the letter B and carried by the insulating sleeve 14.

In accordance with the invention basic cold cups 12, 12 and insulating sleeves 14, 14 are supplied by the cup manufacturer to the user as separate elements. The cold cups 12, 12 may be used in the usual manner to serve cold beverages and food products. However, when a hot cup is required for serving a hot beverage such as coffee or a food product such as hot soup, the user may convert a cold cup 12 into an insulated hot cup 10 by adding an insulating sleeve 14 to the cold cup 12. When the sleeve and the cold cup are brought together in assembly the sleeve instantaneously adheres to the sidewall of the cold cup to form an insulated hot cup assembly, all of which will be hereinafter further discussed.

Figure 3:
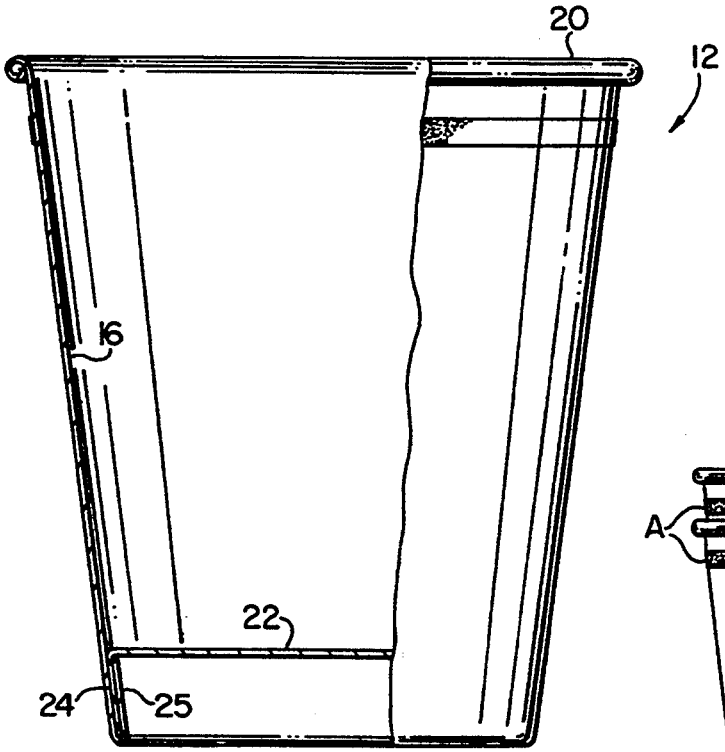
FIG. 3 is a somewhat enlarged side elevational view of the cold cup of FIG. 2 shown partially in axial section.

The basic cold cup 12 comprises a conventional disposable cup of a well known type and may be made from any suitable sheet material, but preferably, it is formed from a biodegradable material, such as paper, using conventional cup forming machinery. Referring particularly to FIG. 3, the basic cup has a substantially smooth axially elongate frustoconical sidewall 16 formed by adhesively joining opposite marginal end portions of a sheet material blank (not shown) in overlapping face-to-face relation to each other to form a seam 18 which extends longitudinally of the sidewall. The upper end portion of the sidewall 16 is rolled or curled outwardly and downwardly forming an annular bead or rim 20 at the upper end of the sidewall 16 and defining a circular opening at the upper end of the cup 10.

A circular bottom wall, indicated at 22 and formed from another sheet material blank, preferably paper, includes a depending annular skirt 24. The skirt is attached in face-to-face relation to the inner surface of the sidewall 16 by a suitable adhesive compound (not shown). The lower marginal portion of the sidewall, indicated by the numeral 25, is rolled inwardly and upwardly into face-to-face relation with the annular inner surface of the skirt 24 and joined to the skirt by a suitable adhesive compound (not shown) to connect the bottom wall 22 in substantially liquid tight engagement to the frustoconical sidewall 16, as best shown in FIG. 3.

Figure 4:
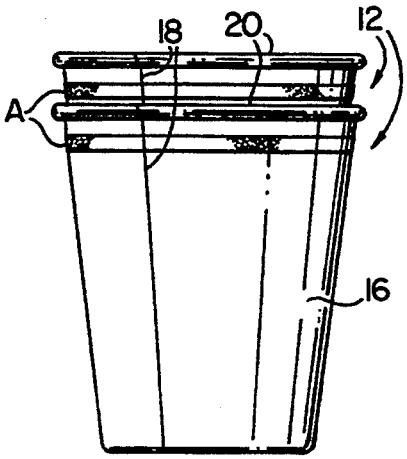
FIG. 4 is a somewhat reduced side elevational view showing one cold cup nested within another cold cup of like kind.
Figure 5:
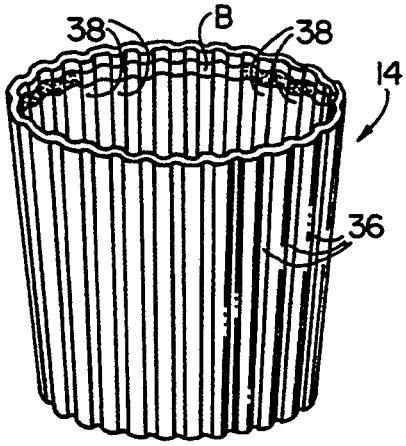
FIG. 5 is a perspective view of the insulating sleeve used in making the assembly shown in FIG. 1.
Figure 6:
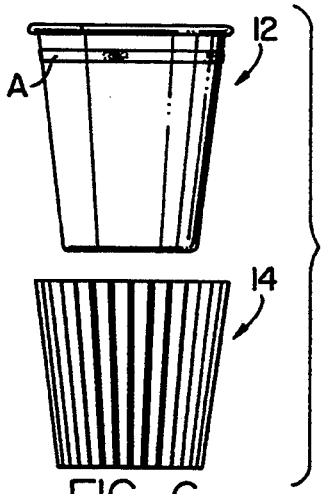
FIG. 6 is a somewhat reduced exploded side elevational view illustrating the manner in which an insulating sleeve is assembled with a cold cup.
Figure 8:
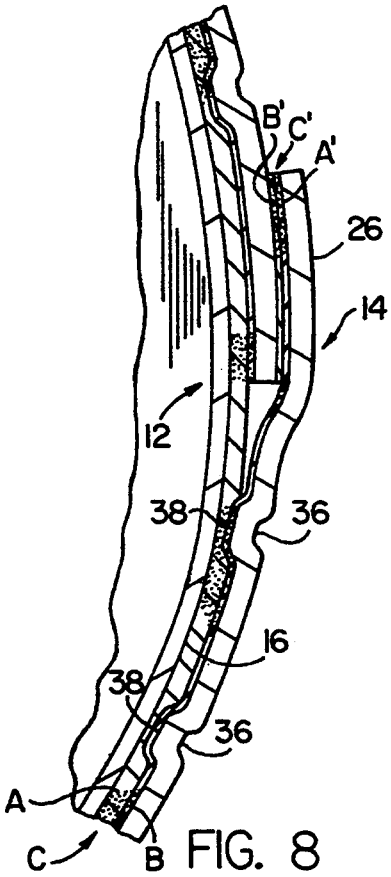
FIG. 8 is a somewhat enlarged fragmentary sectional view taken generally along the line 8—8 of FIG. 1.
Figure 7:
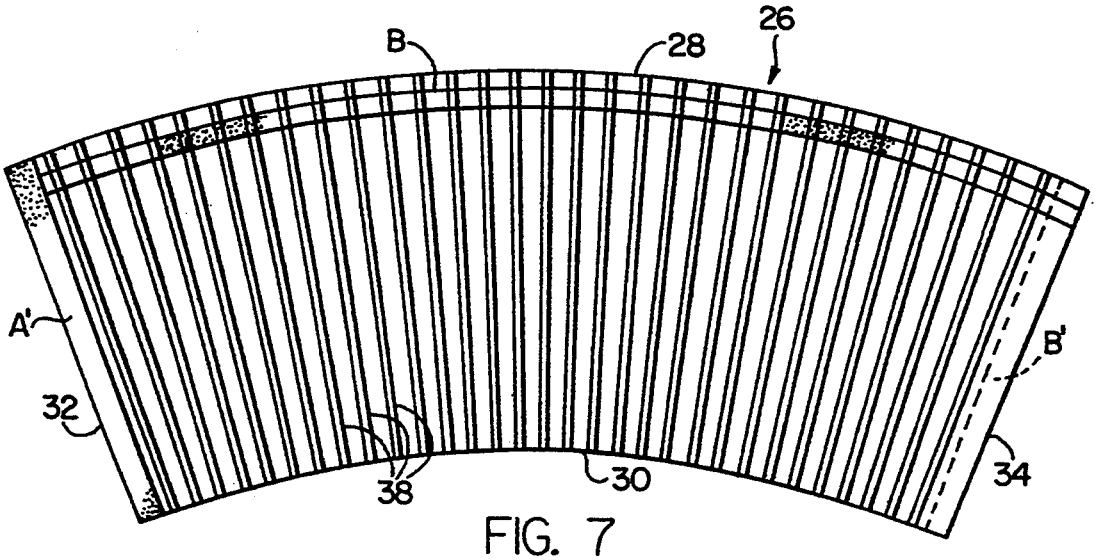
FIG. 7 is a side elevational view of an insulating sleeve blank for assembly with a cold cup in accordance with the invention.

The sleeve 14, shown in FIG. 4, is formed from a sleeve blank cut from sheet material, preferably paper. A typical sleeve blank, shown in FIG. 6 and indicated generally at 26, is preferably formed by a cutting or blanking machine operation. The resulting formed blank 26 has arcuate upper and lower edges indicated at 28 and 30, respectively, which have a common center of curvature but differing radii of curvature. The sleeve blank 26 is further defined by opposite side marginal portions 32 and 34 and may be sized to cover the entire exposed outer surface of the sidewall or only a portion of the exposed sidewall surface, as shown in FIG. 1.

The insulating sleeve 14 is further prepared by forming or scoring a plurality of spaced apart and generally radially extending shallow indentations 36, 36 in the outer surface of the blank 26 to produce corresponding radially extending ribs 38, 38 which project inwardly from the opposite or inner surface of the blank 26. The ribs 38, 38 are preferably equiangularly spaced apart and may terminate in spaced relation to the upper and lower marginal edges 28 and 30 or may extend across the entire blank 26 between the latter marginal edges substantially as shown in the drawings. The blank cutting and the rib forming operations are preferably simultaneously performed using a blanking and forming press.

Figure 2:
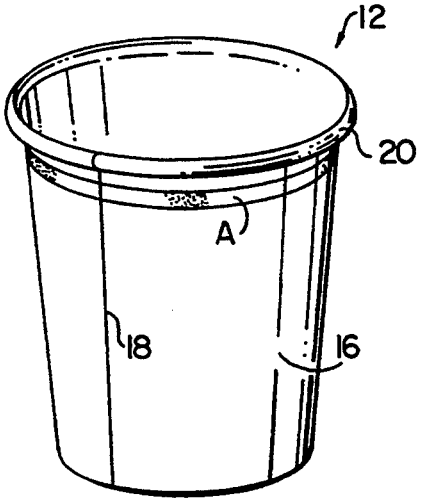
FIG. 2 is a perspective view of a basic cold cup used in the assembly shown in FIG. 1.

The frustoconical insulating sleeve 14 formed from the sleeve blank 26 is used to convert the basic cold cup, the cup 12, shown in FIGS. 2–4 into an insulated hot cup 10, shown in FIG. 1 and suitable for dispensing hot drinks or other hot food products. In order to assure that the insulating hot cup possess the required structurally integrity to withstand normal handling and resist separation of the sleeve from the cup the sleeve 14 is adhered to the cup 12, and it is for this reason that the cohesive material C is employed.

Cohesive materials are well known in the adhesive art and have been used extensively in the production of other products such as selfsealing envelopes, for example, and various cohesive materials are presently available which are suitable for use in practicing the present invention. An ideal cohesive material for use in practicing the invention is one which comprises two parts or substances, neither of which is particularly tacky per se. Each of two substances is applied to a separate carrier. When the two substances are brought into contact with each other at least one of the substances becomes instantaneously tacky and forms an effective adhesive layer which immediately adhesively joins the two carriers in assembly.

The cohesive compound used must be formulated so that the two parts of the compound remain stable and resist deterioration at ambient temperature while providing effective cohesion in the temperatures range normally encountered in use.

One cohesive system employs an adhesive precursor layer which is applied to an associated carrier and a tackifier layer which is applied to the another carrier. The aforesaid product may be formulated to provide an instantaneous aggressive tack to secure the two carriers in substantially permanent assembly with each other when the two cohesive layers are brought together in substantial face-to-face engagement with each other. Cohesive materials of the type generally aforedescribed are discussed in U.S. Pat. No. 4,391,853, to Pointon, issued Jul. 5, 1983, and hereby adopted by reference as part of the present disclosure.

Further considering the insulated cup assembly 10, one of the components A, B which comprise the cohesive compound C is carried by the cold cup 12 whereas the other of the components A, B is carried by the insulating sleeve 14. At least one of the components A, B comprises a coaxial annular layer or band whereas the other of the components may comprise a single patch of cohesive material or a plurality of angularly spaced apart patches of material for registry with the annular band when the cup 12 and sleeve 14 are brought together in assembled condition.

In accordance with the presently preferred method for practicing the invention the part A comprises an adhesive precursor layer or annular band applied to the outer surface of the cold cup 12 in downwardly spaced relation to the cup rim 20 so that a user's lips will not touch the band A during normal cup usage. Preferably, and as shown, the distance between the upper surface of the cup rim and the lower edge of the annular band A, measured in an axial direction, is less than the axial distance between the lower edge of the cup and the upper surface of the bottom wall. This dimensional relationship assures that when a plurality of cold cups are stored in nested relation to each other, as shown in FIG. 4, the adhesive precursor layer A on the nested cup will not enter the cup therebelow to contaminate the rim or inner surface of the cup.

The other cohesive component or tackifier layer B is applied to the inner surface of the sleeve 14. The tackifier layer B may comprise a single patch of material, but preferably, and as shown, it also comprises an annular band. The two annular bands of material A and B are disposed on the cup and on the sleeve for registry with each other when the sleeve is assembled on the cup. The inner surfaces of the frustoconical sleeve 14, defined by the ribs 38, 38 are arranged for complementary engagement with the outer surface of the cup sidewall when the sleeve is in assembled condition with the cup.

As shown, one of the cohesive bands is preferably somewhat wider than the other so that when the sleeve 14 is brought into assembled engagement with the cup 12 proper registration between the cohesive bands will be substantially assured. Since the inner surfaces of the sleeve, defined by the ribs 38, 38, substantially complement the outer surface of the sidewall 16 some degree of "taper lock" will occur when the sleeve is seated on the cup sidewall. This arrangement assures that the tackifier layer will be brought into activating engagement with the adhesive precursor layer as a result of the pressure normally applied to bring the two parts into assembly. Thus, the sleeve 14 will be instantaneously and permanently adhered to the cup 12 during assembly.

The present concept of supplying separate cold cups and insulating sleeves for permanent assembly by the user at the time of use enables a substantial reduction in the cost of producing hot cups enabling the producer to make such cups available to the user at reduced cost.

In accordance with a further concept of the invention insulated sleeves may be supplied to the user as flat sleeve blanks to be formed into sleeves and assembled by the user, as required. When sleeves are provided in flat blank form each sleeve carries a quantity of a cohesive compound B on the inner surface thereof for registry with a cohesive compound A carried by an associated cold cup. In addition, a strip of one of the compounds A, B is applied to the inner side of the blank at the marginal portion 32, as indicated at A' and another strip of the compound B is applied to the outer side of the blank at the marginal portion 34 as indicated at B', thereby enabling the sleeve blank to be wrapped about an associated cold cup 12 and joined by bringing the cohesive strips or layers A' and B' into engagement to form a seam such as the seam 18.

Supplying the sleeve blanks to the ultimate user in fiat form substantially reduces the space required to maintain an inventory of hot cups. This space saving feature is particularly important to the operator of a small restaurant or fast food establishment having limited storage space.

I claim:

1. An article of manufacture comprising a disposable cold cup formed from sheet material for containing cold liquid and having a frustoconical sidewall, a radially disposed annular rim at the upper end of said sidewall defining an opening at said upper end, and a radially disposed bottom wall, and means for converting said disposable cold cup into a disposable insulated cup for containing hot liquid and including a frustoconical insulating sleeve made from sheet material for coaxially receiving said disposable cold cup in an assembled condition therein, and a cohesive material having two parts including a first part disposed on a portion of the outer surface of said sidewall and a second part disposed on a portion of the inner surface of said sleeve for registry with said first part in said assembled condition, said first and second parts instantaneously cooperating in adhering engagement with each other when brought into contact with each other in said assembled condition to permanently retain said sleeve in insulating assembly with said sidewall, whereby said insulating sleeve may be permanently assembled with said cold cup by a user at the time of use.

2. An article of manufacture as set forth in claim 1 wherein at least one of said parts comprising said first and second parts comprises an annular band.

3. An article of manufacture as set forth in claim 2 wherein both of said parts comprise annular bands.

4. An article of manufacture as set forth in claim 2 wherein the other of said parts comprising said first and second parts comprises a patch of adhesive.

5. An article of manufacture as set forth in claim 1 wherein one of said parts including said first and second parts comprises an adhesive precursor and the other of said parts comprises a tackifier.

6. An article of manufacture as set forth in claim 1 wherein said disposable cold cup is nestable within another cold cup of like kind and said first part on said disposable cold cup is disposed above said rim of said other cold cup when said disposable cold cup is nested within said other cold cup.

7. An article of manufacture as set forth in claim 1 wherein said spacing means comprises circumaxially spaced apart projections on said inner surface.

8. An article of manufacture as set forth in claim 7 wherein said projections comprises ribs.

9. An article of manufacture comprising a disposable cold cup formed from sheet material for containing cold liquid and having a frustoconical sidewall, a radially disposed annular rim at the upper end of said sidewall defining an opening at said upper end and a radially disposed bottom wall, and means for converting said disposable cold cup into a disposable insulated hot cup at the time of use for containing a hot liquid and including a frustoconical insulating sleeve made from sheet material for coaxially receiving said disposable cold cup in assembled condition therein, and retaining means for instantaneously securing said insulating sleeve in permanent assembly with said disposable cold cup when said disposable cold cup and said insulating sleeve are brought together in said assembled condition and including first means carried by said disposable cold cup and second means carried by said insulating sleeve for instantaneously cooperating in permanent holding engagement with said first means in said assembled condition whereby said insulating sleeve may be assembled with said disposable cold cup by the user of said disposable insulated hot cup and at the time of use.

10. An article of manufacture as set forth in claim 9 wherein said retaining means comprises a cohesive material having two parts and wherein said first means comprises one of said parts and said second means comprises the other of said parts.

11. An article of manufacture as set forth in claim 10 wherein at least one of said parts comprises an annular band of material.

12. An article of manufacture as set forth in claim 10 wherein each of said parts comprises an annular band of material.

13. An article of manufacture as set forth in claim 11 wherein said one part comprises a layer of an adhesive precursor material and the other part comprises a layer of a tackifying material.

14. An article of manufacture as set forth in claim 11 wherein said annular band is disposed on said disposable cold cup.

15. An article of manufacture as set forth in claim 9 wherein said retaining means comprises a cohesive material including a layer of an adhesive precursor material and a layer of a tackifying material.

16. An article of manufacture as set forth in claim 9 wherein said sleeve comprises a sheet material blank having overlapping opposite marginal portions joined together by said cohesive material.

17. A method for converting a disposable cold cup into a disposable insulated cup at the time of use comprising the steps of providing a cohesive material including two parts which instantaneously adhere to each other upon contact with each other, applying one part of the cohesive material to the outer surface of the cold cup, forming an insulating sleeve for receiving and engaging the cold cup in an assembled condition therein, applying a quantity of the other part of the cohesive material to the inner surface of said sleeve for registry with the one part in the assembled condition, and moving the cold cup into assembled condition the sleeve at the time of use to bring the one part into face-to-face engagement with the other part causing the one part and the other part to instantaneously cooperate in adhering engagement with each other to permanently secure the insulating sleeve in insulating assembly with the cold cup.

18. A method for converting a disposable cold cup into a disposable hot cup at the time of use as set forth in claim 17 wherein the step of forming a sleeve comprises cutting from substantially flat sheet material a sleeve blank having opposite marginal end portions, applying a quantity of one part of the cohesive material to one surface of the sleeve blank at one marginal end portion of the blank, applying a quantity of the other part of the cohesive material to the other surface of the blank at the other marginal end portion of the blank, forming the blank into a sleeve, and joining the one marginal end portion of the blank in overlapping relation to the other marginal end portion of the blank by adhering the one part on the one marginal end portion to the other part on the other marginal end portion.

19. A method for converting a disposable cold cup into a disposable insulated cup at time of use as set forth in claim 17 wherein the step of applying a quantity of one part to the outer surface is further characterized as applying a coaxial band of the one part to the outer surface of the cold cup.

20. A method for converting a disposable cold cup into a disposable insulated cup at time of use as set forth in claim 19 wherein the step of applying a quantity of the other part to the inner surface is further characterized as applying a band of the other part to the inner surface of said sleeve.

* * * * *